United States Patent [19]

Rimmer

[11] Patent Number: 4,798,063

[45] Date of Patent: Jan. 17, 1989

[54] BEVERAGE COOLER

[76] Inventor: James Rimmer, Rte. 1, Arkona, Ontario, Canada, N0M 1B0

[21] Appl. No.: 123,727

[22] Filed: Nov. 23, 1987

[51] Int. Cl.[4] ..... F25D 3/08

[52] U.S. Cl. ..... 62/457; 62/371

[58] Field of Search ..... 62/457, 371

[56] References Cited

U.S. PATENT DOCUMENTS

| | | | |
|---|---|---|---|
| 3,302,428 | 2/1967 | Stoner et al. | 62/371 X |
| 3,807,194 | 4/1974 | Bond | 62/457 |
| 4,183,226 | 1/1980 | Moore | 62/457 |
| 4,299,100 | 11/1981 | Crisman et al. | 62/457 |
| 4,324,111 | 4/1982 | Edwards | 62/457 |
| 4,344,303 | 8/1982 | Kelly, Jr. | 62/457 X |
| 4,383,422 | 5/1983 | Gordon et al. | 62/457 |
| 4,393,975 | 7/1983 | Moore | 62/457 X |
| 4,531,381 | 7/1985 | Toro et al. | 62/457 X |
| 4,638,645 | 1/1987 | Simila | 62/457 |

*Primary Examiner*—Lloyd L. King

*Attorney, Agent, or Firm*—Leon Gilden

[57] ABSTRACT

A cylindrical beverage cooling apparatus is set forth formed with a plurality of wall layers varying from a most dense outer wall to a least dense inner wall to contact a container positionable therein to maintain cooling thereof. Circular ribs formed on said inner wall are positioned along the inner wall length thereof for maintaining frictional contact with an inserted container and for providing air gaps for said container to enhance a cooling effect. A floor mounted enclosure is filled with a freezable liquid for imparting cooling to an inserted can or bottle within said beverage cooler. Formed on a lid at the entrance of the cooler are a series of encircling flap elements to engage an upper surface of an inserted container to accommodate variations in container configuration while maintaining a sealing contact therewith to contain cooling air within said beverage container.

1 Claim, 1 Drawing Sheet

BEVERAGE COOLER

BACKGROUND OF THE INVENTION

1. Field of the Invention

The present invention relates to beverage coolers and more particularly pertains to a new and improved beverage cooler for maintaining the cooling of a beverage inserted therein by both mechanical and heat flow controlling means.

2. Description of the Prior Art

The use of beverage coolers and the like is well known in the prior art. As may be appreciated, these devices have either been of limited effectiveness or have been of such elaborate construction as to resist their being utilized. Compact size, convenience, and ease of handling are all characteristics required in an effective beverage cooler arrangement. In this connection, there have been several attempts to develop beverage cooler device which may be easily and efficiently utilized when desired. For example, U.S. Pat. No. 2,773,358 to Palmer, et al. illustrates the use of a self-cooling container wherein an enclosed freon capsule is positioned within a hollow wall portion of the container structure and when the freon is released, cooling is accordingly effected. The rather complex and awkward ogrganization of the Palmer patent renders it somewhat ineffective for convenient use.

U.S. Pat. No. 2,779,495 to Davis illustrates the use of a cooling beverage container illustrates the use of an insertable member to receiving a drinking glass or the like for providing storage thereof.

U.S. Pat. No. 3,205,677 illustrates the use of a beverage cooling unit wherein a truncated conical organization accepts a like configured glass for maintaining cooling thereof wherein a somewhat rigid exterior wall includes a liner containing a membrane to enclose a liquid refrigerant to maintain coolant about the surface of the positioned glass. The Stoner patent limits the type of containers to be cooled and furthermore, once the refrigerant utilized by Stoner is cooled to a less than liquid state, the insertion or removal of containers from the Stoner apparatus becomes somewhat difficult.

U.S. Pat. No. 3,205,678 also to Stoner is a modification of the previously noted Stoner patent and the rather elaborate construction of the '678 Stoner patent is not of sufficiently unique organization to overcome the problems associated with the previously noted patent. The full wall use of refrigerant renders the use of such coolers somewhat uncomforable and of unnecessarily awkward and complex construction.

U.S. Pat. No. 3,269,144 to Poris illustrates a container cooler formed with a plural wall organization and a refrigerant formed therebetween in much the same manner as the Stoner device.

U.S. Pat. No. 3,282,068 to Cain sets forth a strap-on coolant unit for a beverage container wherein the refrigerant within the exteriorly positioned cooling element provides limited heat transfer to adequately maintain a beverage at a reduced temperature.

U.S. Pat. No. 3,302,427 to Stoner, et al. is another in a series of such patents to provide a liquid filled cooler wall utilizing a refrigerant to maintain adequate heat transfer to an associated container. A variation by Stoner lies in the U.S. Pat. No. 3,365,911 wherein a cradle-like clam shell organization is provided with arcuately shaped inner wall surfaces to enable a bottle or the like to lie within the arcuate surfaces defined by the device to maintain cooling of the bottle by the refrigerant secured within the adjacent hollow walls.

French Pat. No. 762,624 to Guerard presents the use of a hollow walled two part container utilizing ice in one portion for enabling heat transfer to the second. A removable top encloses beverages therein in a conventional manner.

As such, it may be appreciated that there is a continuing need for a new and improved beverage cooling device which addresses both the problem of storage, portability, convenience, and ease of use and in this respect the present invention substantially fulfills this need.

SUMMARY OF THE INVENTION

In view of the foregoing disadvantages inherent in the known types of beverage coolers now present in the prior art, the present invention provides a beverage cooler device wherein the same accommodates a beverage container and maintains same in a desired cooling state by means of plural density wall construction and including an optionally utilized refrigerant as well as mechanical ribs formed within an inner wall surface. As such, the general purpose of the present invention, which will be described subsequently in greater detail, is to provide a new and improved cooling container which has all the advantages of the prior art cooling containers and none of the disadvantages.

To attain this, the present invention comprises a cylindrically shaped cooling container formed with a wall construction of plural density rubber-like material wherein the exterior wall is of the greatest density and the interior of the least density. The plural density wall construction limits heat flow therethrough and provides an improved or efficient thermal barrier. The exterior wall being of the greatest density maintains the shape of the container device and included within the interior surface of the device is a positioned refrigerant on the floor thereof that may be frozen for ultimate use with a container positioned within said device. The combination of opening flaps and interior wall ribs provides an enhanced friction gripping mechanism for the device as well as providing chambers along the wall of the container positioned therein to maintain cooling thereof.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is of enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved beverage cooler which has all the advantages of the prior art beverage coolers and none of the disadvantages.

It is another object of the present invention to provide a new and improved beverage cooler which may be easily and efficiently manufactured and marketed.

It is a further object of the present invention to provide a new and improved beverage cooler which is of a durable and reliable construction.

An even further object of the present invention is to provide a new and improved beverage cooler which is susceptible of a low cost of manufacture with regard to both materials and labor, and which accordingly is then susceptible of low prices of sale to the consuming public, thereby making such beverage coolers economically available to the buying public.

Still yet another object of the present invention is to provide a new and improved beverage cooler which provides in the apparatuses and methods of the prior art some of the advantages thereof, while simultaneously overcoming some of the disadvantages normally associated therewith.

Still another object of the present invention is to provide a new and improved beverage cooler formed of a cylindrical configuration.

Even still a further object of the present invention is to provide a new and improved beverage cooler wherein plural density walls and internal ribs limit heat transfer therethrough and enable enhanced cooling of a container positioned therein.

Another object of the present invention is to provide a cooling container wherein a refrigerant is positioned within a membrane on the floor thereof for optional use in maintaining cooling of a container positioned therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
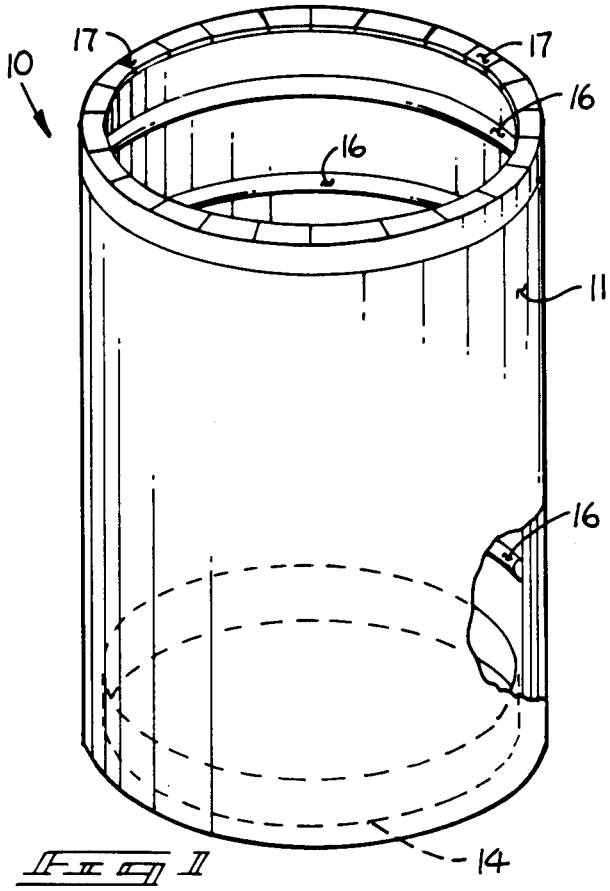
FIG. 1 is an isometric illustration of the beverage cooler of the instant invention.
Figure 3:
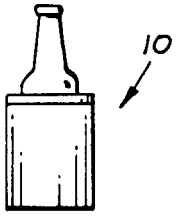
FIG. 3 is an orthographic side view of the beverage cooler of the instant invention with a container positioned therein.
Figure 2:
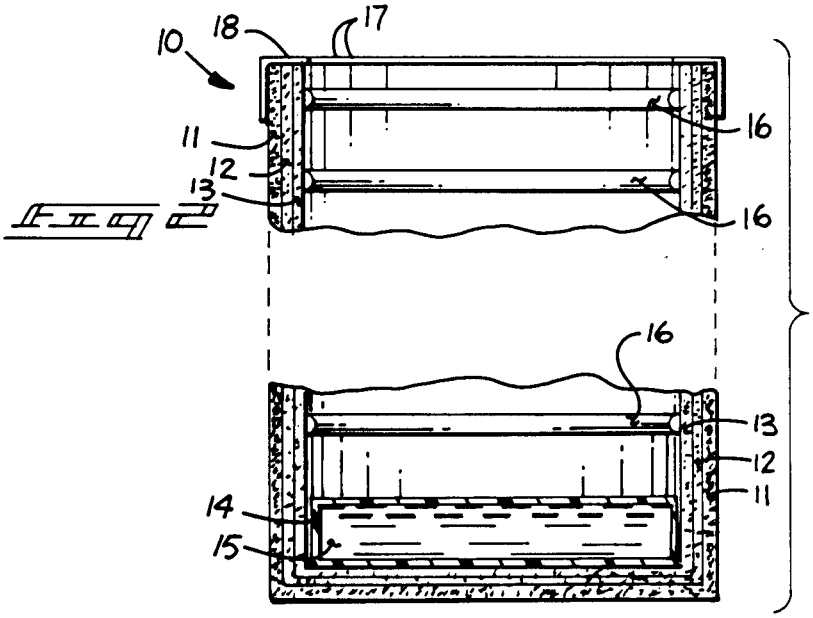
FIG. 2 is an orthographic cross-sectional view of the present invention illustrating the various parts, their configuration and relationship.

With reference now to the drawings, and in particular to FIG. 1 thereof, a new and improved beverage cooler embodying the principles and concepts of the present invention and generally designated by the reference number 10 will be described.

More specifically, it will be noted that the beverage cooler device 10 essentially comprises a cylindrically configured chamber open at one end formed with an outer cylindrical wall 11, a central cylindrical wall 12, and an inner cylindrical wall 13. The aforenoted walls 11, 12, and 13 are formed of a rubber-like material wherein outer wall 11 is of greatest density and inner wall 13 is of the least density whereby heat flow through the plural wall construction is vastly reduced. The wall construction is furthermore carried throughout the walls and floor portion of the thusly formed container. While the use of three walls of varying density is illustrated, it is to be understood that while of diminished effectiveness, a double wall construction may be utilized. Integrally formed on inner wall surface 13 are a series of ribs 16 formed along with the entire inner wall surface extent. A membrane element 14 has positioned therein a refrigerant 15. The membrane 14 is secured to the floor of the container and while not a necessity, the refrigerant 15 may be pre-chilled to freezing temperatures to enhance the cooling of a container positioned within the beverage cooler 10.

Formed at the top or opening of the cooler 10 are a series of flap portions 17 formed either integrally to the container or as illustrated to a removable cap portion 18 that is positionable about an inserted container to accommodate a variety of container peripheral configurations and their variations and enhance the maintenance of an adequately cooled temperature environment within the interior of said container cooler 10.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A cooling device for use in cooling cylindrical vessels positionable therein comprising, a plural walled container formed of rubber-like material of varying density for limiting heat flow through said walls, and a cap means formed of a series of individual flexible flap portions defining and entrance of said container integrally formed to said container for firstly securing and accommodating an exterior surface of a vessel positionable within said container and for secondly sealing and engaging said exterior surface to thereby limit heat flow to the interior of said container, and wherein the pluraled walls comprise three walls wherein said exterior wall is of greatest density, said central wall is of intermediate density, and said interior wall of least density wherein the exterior wall maintains the integrity of the configurational shape and the central and interior walls discourage heat flow through the walls, and wherein a plurality of spaced continuous circumferential ribs are positioned and integrally formed onto the inner wall along the length thereof for providing air pockets against a vessel positionable within said container, and wherein a flexible membrane is secured to a defined floor of the container wherein said membrane has positioned therein a refrigerant.

* * * * *